United States Patent [19]

Russell et al.

[11] Patent Number: 4,922,731

[45] Date of Patent: May 8, 1990

[54] QUARTZ CONDUCTIVE BAFFLES FOR HEAT REMOVAL AND METHOD

[75] Inventors: Joseph K. Russell, Allen; Jeffrey A. McKee, Dallas, both of Tex.

[73] Assignee: Texas Instruments Incorporated, Dallas, Tex.

[21] Appl. No.: 252,227

[22] Filed: Sep. 30, 1988

[51] Int. Cl.[5] ..... F25B 39/02

[52] U.S. Cl. ..... 62/515; 62/383; 165/169; 165/181; 219/10.55 A

[58] Field of Search ..... 62/383, 259.2, 515; 165/164, 169, 181; 219/10.55 A

[56] References Cited

U.S. PATENT DOCUMENTS

| | | | |
|---|---|---|---|
| 3,909,574 | 9/1975 | Muller et al. | 219/10.55 A |
| 4,310,738 | 1/1982 | Moretti et al. | 219/10.55 A |
| 4,425,936 | 1/1984 | Goss | 165/164 |

*Primary Examiner*—Ronald C. Capossela
*Attorney, Agent, or Firm*—B. Peter Barndt; James T. Comfort; Melvin Sharp

[57] ABSTRACT

A downstream remote processor (40) having a quartz waveguide (54) is cooled by at least one baffle (66). The baffle (66) comprises quartz and is fused to the waveguide (54) so as to contact an inner wall (44) of a container (42). At least one void (68, 70) is formed through baffle (66) to allow a cooling fluid to pass therethrough. The cooling fluid is injected into the container (42) by a pump (72) through an elbow shaped inlet (74). The cooling fluid passes over the waveguide (54) and through the voids (68 and 70). Through the combined effects of the baffle (66) and the cooling fluid which is circulated through the container (42), heat generated within the waveguide (54) is dissipated thus avoiding rapid deterioration thereof and greatly reducing the deposition of contaminants in the wafer (60).

34 Claims, 3 Drawing Sheets

QUARTZ CONDUCTIVE BAFFLES FOR HEAT REMOVAL AND METHOD

TECHNICAL FIELD OF THE INVENTION

This invention relates in general to semiconductor processing, and in particular to a method and apparatus for removing heat from a downstream remote processor using quartz conductive baffles.

BACKGROUND OF THE INVENTION

Semiconductor wafer processing typically requires several stages of surface etching and layer depositing to form circuits. One device used to perform such etching and depositing is known as a downstream remote processor which comprises a water cooled aluminum housing surrounding a quartz waveguide. The waveguide comprises a length of a quartz tube passing through the aluminum container. The quartz tube has an open end exterior the container proximate a wafer which is to be processed.

A magnetron is attached to or positioned within the container to transmit microwaves throughout the container. The microwaves pass through the quartz and excite a reactive species which is introduced from external the container to the quartz tube. The microwaves cause the reactive species to be excited, forming radicals and free electrons which generate heat that is passed to the quartz tube. The heat, in conjunction with the radicals and the free electrons bombarding the quartz, causes the quartz to deteriorate. Deterioration results in small particles of the quartz tube being removed and carried with the radicals enroute to the silicon semiconductor wafer. Upon reaching the open end of the quartz tube, the plasma is directed onto a wafer for processing thereof.

Since small particles of quartz are carried with the radicals, some quartz is deposited on the surface of the wafer. The quartz particles then become contaminants which interfere with the circuitry being formed on the wafer. Additionally, the constant deterioration of the quartz tube results in the eventual destruction thereof requiring replacement. While quartz tubes are relatively inexpensive, the wafers being processed are not. Thus, there is a need for a method and apparatus to remove heat from the quartz tube to slow down the deterioration thereof and to lessen the likelihood of contamination of the wafer by the deposition of quartz particles.

SUMMARY OF THE INVENTION

The present invention disclosed herein comprises a method and apparatus for removing heat from a downstream remote processor which substantially eliminates or reduces problems associated with deterioration thereof. The present invention allows the removal of heat from a quartz waveguide within the processor by the use of heat conductive baffles and a cooling fluid.

In accordance with one aspect of the present invention, a container is formed around the quartz waveguide in a downstream remote processor. At least one heat conductor is interconnected between the waveguide and the container to allow heat generated within the waveguide to be removed from the waveguide to the container.

In another aspect of the present invention, the conductor comprises a quartz baffle fused to the quartz waveguide. The baffle has at least one port passing therethrough to allow the circulation of a cooling fluid throughout the container. The cooling fluid is pumped into the container surrounding the waveguide to assist the baffle with the removal of heat.

It is a technical advantage of the present invention that heat generated during the creation of plasma within a remote processor is removed. It is a further technical advantage that the removal of heat slows down the deterioration of the quartz waveguide and is thus economically advantageous. It is a still further technical advantage of the present invention that the likelihood of quartz contaminants being deposited onto the wafer is lessened.

BRIEF DESCRIPTION OF THE DRAWINGS

For a more complete understanding of the present invention and for further advantages thereof, reference is now made to the following Detailed Description, taken in conjunction with the accompanying Drawings, in which.

DETAILED DESCRIPTION OF THE INVENTION

Figure 1:
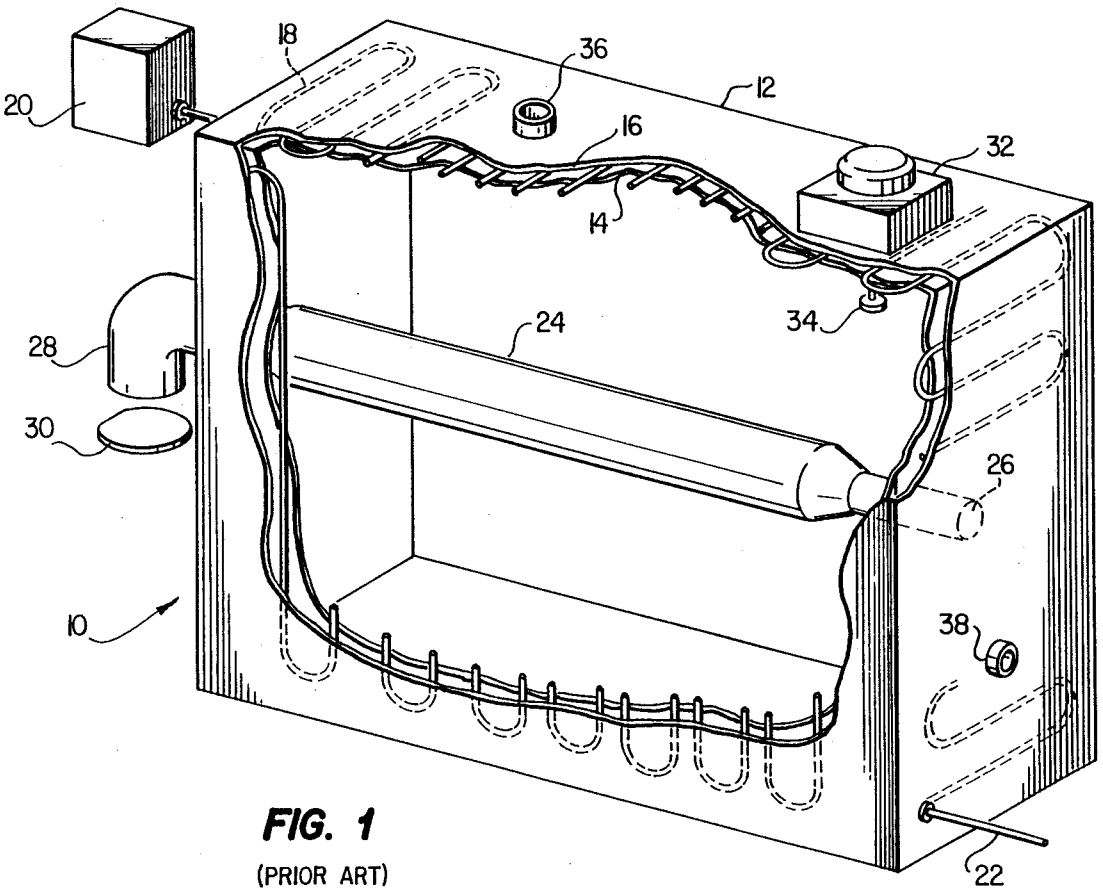
FIG. 1 (PRIOR ART)
FIG. 1 is a partially cutaway perspective view of a downstream remote plasma processor constructed in accordance with the prior art.

Referring to FIG. 1, a partially cutaway perspective view of a downstream remote processor constructed in accordance with the prior art is generally identified by the reference numeral 10. The processor 10 comprises a container 12 having an inner wall 14 and an outer wall 16. Sandwiched between the inner wall 14 and the outer wall 16 is a circuitous system of pipes 18 which has a cooling fluid pumped therethrough by a pump 20. The cooling fluid within pipes 18 is designed to keep the container 12 from overheating as a result of activity within processor 10. Pipes 18 may be either a closed loop system or a flow-through system having an outlet 22.

Passing through the container 12 is a waveguide 24 which may comprise a quartz tube. Waveguide 24 is interconnected on a first end 26 to a source (not shown) for providing a processing reactive species. A second end 28 of waveguide 24 opens proximate a semiconductor wafer 30. A magnetron 32 is positioned exterior the container 12 with a transducer 34 passing through the inner and outer walls 14–16. Magnetron 32 generates microwave throughout the container 12.

In operation, a reactive species such as sulphur hexafluoride ($SF_6$) enters waveguide 24 through first end 26. The magnetron 32 emits microwaves via the transducer 34 into the container 12 which pass through the waveguide 24 and excite the reactive species therein creating radicals and free electrons. As the radicals pass further along waveguide 24, they exit through second end 28 onto wafer 30 which is thereby processed. Heat generated within the waveguide 24 by the creation of the radicals is removed only by the normal flow of air through an inlet 36 and an outlet 38 and by the cooling surface of the inner wall 14.

As the reactive species is excited, molecular radicals are created which have a high degree of energy. The radicals are free to travel back and forth within the waveguide 24 running into the walls of the waveguide 24. Since the quartz material is not cooled sufficiently in processor 10, the radicals are more likely to strip quartz particles from the walls of waveguide 24. The stripping of particles deteriorates and eventually ruins the waveguide 24, as well as interferes with the processing of the wafer 30.

Figure 2:
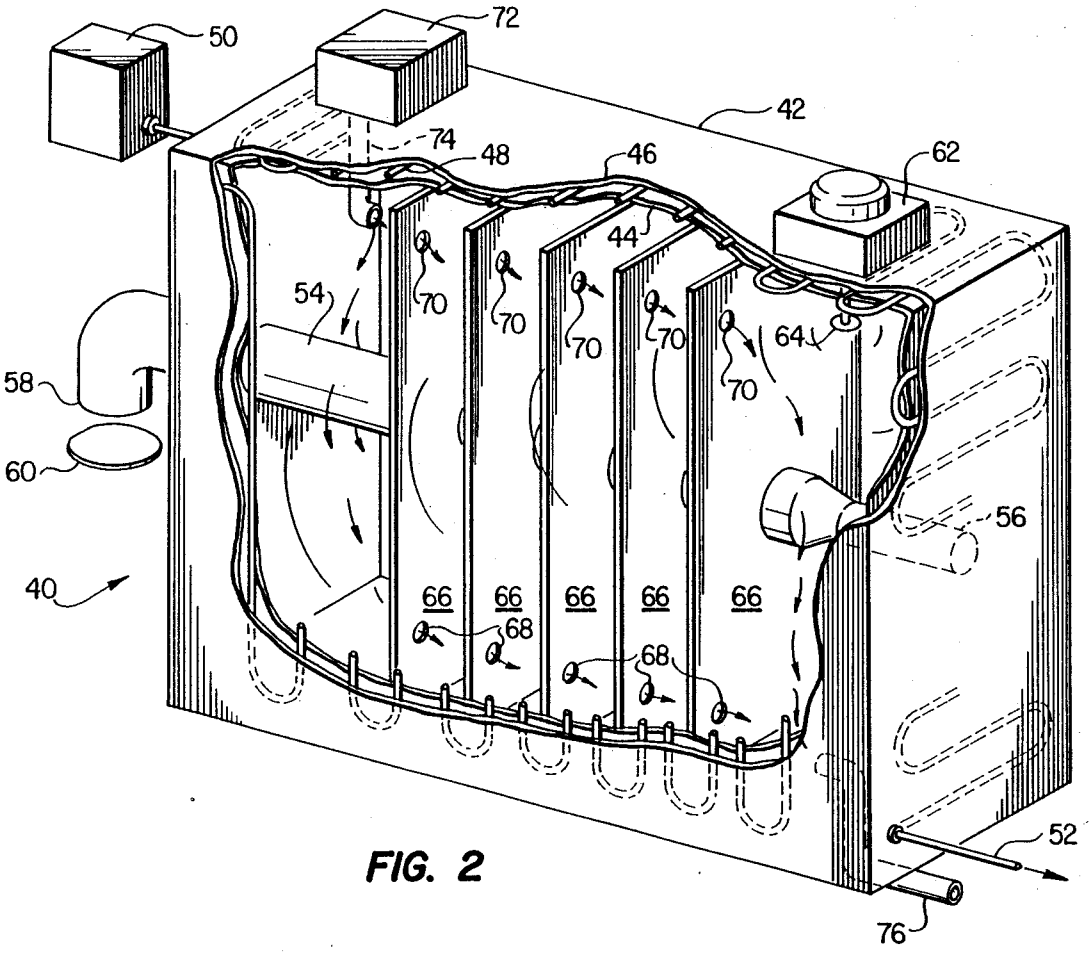
FIG. 2 is a partially cutaway isometric view of a downstream remote plasma processor constructed in accordance with the preferred embodiment of the present invention.

Referring to FIG. 2, a downstream remote processor constructed in accordance with the preferred embodiment of the present invention is generally identified by the reference numeral 40. The processor 40 comprises a container 42 having an inner wall 44 and an outer wall 46 with a circuitous pipe 48 sandwiched there between. A pump 50 feeds a cooling fluid into the pipe 48 to cool the walls of container 42. An outlet 52 may be provided to allow a constant flow of fresh coolant through the pipe 48.

A waveguide 54 is secured within the container 42. The waveguide 54 may comprise quartz or any other appropriate material that allows microwaves to pass freely therethrough. Waveguide 54 has a first end 56 for receiving a processing gas from a source (not shown) and a second open end 58 which is positioned proximate a wafer 60 for processing. A magnetron 62 is positioned on outer wall 46 of container 42 (or within 42 if so desired) with a transducer 64 passing therethrough to allow microwaves to be emitted within the container 42.

Fixed to the waveguide 54 is at least one baffle 66. The baffles 66 preferably comprise the same quartz material as the waveguide 54 and are affixed thereto by any appropriate method such as fusing. The baffles 66 are generally rectangular in shape and may also be in contact with the inner wall 44 of the container 42. Voids 68 and 70 pass through the baffles 66 as will be subsequently described in greater detail.

Fixed to the outer wall 46 of the container 42 is a pump 72 which is interconnected through the container 42 by a specially designed elbow tube 74. Distal the elbow tube 74 and also passing through container 42 is a second elbow tube 76. Tubes 74 and 76 are designed to allow a cooling fluid to enter into the container 42 and exit therefrom without allowing the direct exit from container 42 of microwaves emitted by the magnetron 62. By having an elbow shape, tubes 74 and 76 require a microwave to be reflected from several surfaces prior to being allowed to exit container 42. Thus, microwaves are generally not allowed to exit the container 42, and a personnel hazard from microwave radiation is greatly reduced.

In operation, a gas such as $SF_6$ enters the waveguide 54 through the first end 56. The magnetron 62 emits microwaves from the transducer 64 which permeate the container 42 passing through the waveguide 54 and the baffles 66. The microwaves excite the reactive species within waveguide 54, forming radicals and free electrons that create heat that is transferred to the waveguide 54. The radicals then continue to second open end 58, where processing of wafer 60 is conducted. The heat generated within the waveguide 54 is removed from the waveguide 54 by the baffles 66 and is then transferred from the baffles 66 to the inner wall 44 of container 42, which is cooled by the pipe 48.

In addition to the conductive cooling by the baffles 66, waveguide 54 is cooled by a cooling fluid injected into container 42 from pump 72 through elbow 74. The cooling fluid injected into the container 42 follows a path around the waveguide 54 and through the voids 68 and 70. The cooling fluid is allowed to exit container 42 through elbow 76 thus allowing a constant flow of fresh coolant. The combination of cooling provided by the baffles 66 and the cooling fluid reduces the damage to the waveguide 54 from heat and from radicals and free electrons. A reduction in damage to the waveguide 54 also results in a reduction of the likelihood of quartz contaminants being deposited on the wafer 60 during processing thereof. Thus, an improved downstream remote processor 40 provides more efficient cooling of the waveguide 54 reducing damage to the waveguide 54 as well as to the wafer 60.

Figure 3:
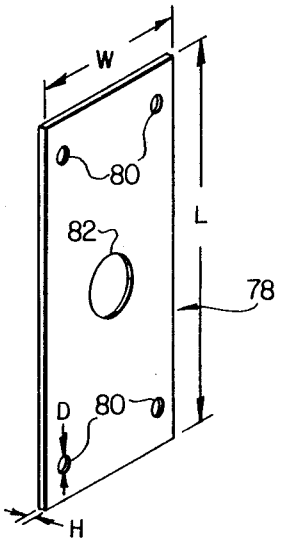
FIG. 3 is a perspective view of a baffle of the present invention.

Referring to FIG. 3, a baffle constructed in accordance with the preferred embodiment of the present invention is generally identified by the reference numeral 78. The baffle 78 preferably comprises a quartz material similar to that of the waveguide 54 (FIG. 2). It is essential that the baffle 78 be securely fixed to the waveguide and be of a material which allows microwaves to pass freely therethrough.

The baffle 78 has a length L, a width W and height H which may be, for example, L=3 inches, W=1.25 inch and H=0.25 inch. Baffle 78 has at least one void 80 passing therethrough to allow cooling fluids to circulate. Void 80 has a diameter D, for example, D=⅛ inch, which must be sufficiently large to allow the free passage of fluid therethrough. The number of voids 80 is preferably 5 or less to avoid a loss of the conductivity of baffle 78. Passing approximately through the center of the baffle 78 is a passage 82, which allows the baffle 78 to be positioned on the waveguide 54.

Although not shown, it is to be understood that the number of baffles 78 to be placed in a processor may vary from as few as 1 to as many as will fit within the processor and still provide cooling thereof. It is also to be understood that the shape of the baffle 78 may vary. For example, baffle 78 could be triangular in shape or any other appropriate shape that will provide sufficient heat conductivity and allow circulation of a cooling fluid.

Figure 4:
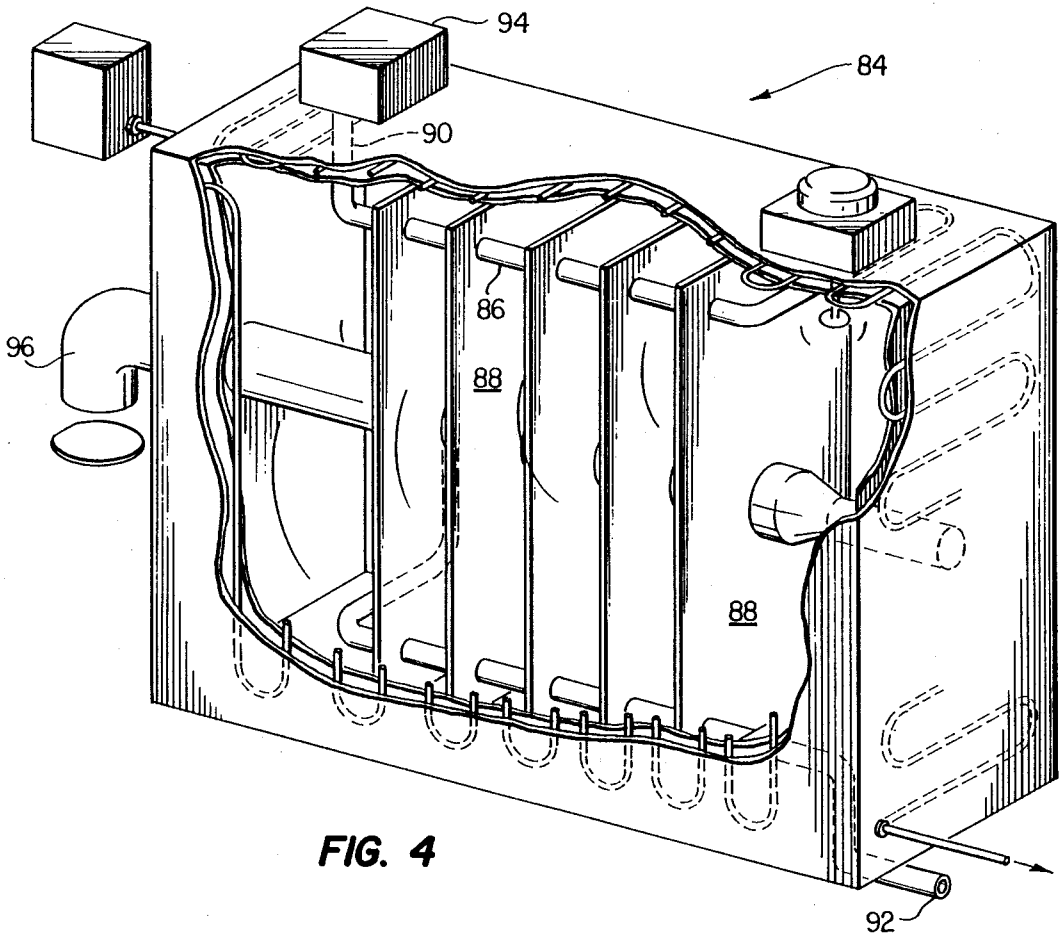
FIG. 4 is an isometric view of an alternate embodiment of the present invention.

Referring to FIG. 4, an alternate embodiment of the present invention is illustrated. A downstream remote processor is generally identified by the reference numeral 84 and is of substantially the same construction as previously shown in FIG. 2. However, the processor 84 is provided with an additional tube 86 passing through baffles 88 in a circuitous route connecting an inlet 90 and an outlet 92.

The tube 86 provides a container for a cooling fluid, which is provided by a pump 94. By utilizing the tube 86, it may be possible to use a liquid coolant (providing the liquid freely passes microwaves) to assist baffles 88 in cooling waveguide 96. Tube 86 must comprise a material that may be firmly affixed, such as by fusing, to baffles 88 and must allow the free passage of microwaves. Thus, it is preferable that the tube 86 comprise the same quartz material as the baffles 88 and the waveguide 96.

The invention disclosed herein provides prolonged life for a quartz waveguide in a downstream remote processor. The improved cooling of the waveguide slows down the deterioration thereof as well as greatly reduces the likelihood of quartz contaminants being deposited on the wafer. Therefore, the particular advantages of a remote processor (i.e., greatly enhanced selectivity) are not lost to the destruction of the wafer by contaminants.

Although the present invention has been described with respect to a specific preferred embodiment thereof, various changes and modifications may be suggested to one skilled in the art, and it is intended that the present invention encompass such changes and modifications as fall within the scope of the appended claims.

What is claimed is:

1. Apparatus for cooling a waveguide in a downstream remote processor, comprising:

a container surrounding the waveguide; and at least one heat conductor interconnecting the waveguide and said container such that heat generated within the waveguide is removed by said conductor to said container.

2. The apparatus of claim 1, wherein said at least one conductor comprises a baffle fixed to the waveguide and in contact with said container, said baffle having at least one void passing therethrough.

3. The apparatus of claim 2, wherein said baffle comprises quartz fused to the waveguide.

4. The apparatus of claim 2, wherein said at least one conductor further includes a fluid coolant circulated through said container by passing through said void.

5. The apparatus of claim 4, wherein said fluid comprises nitrogen.

6. The apparatus of claim 4, further including a pump for forcing said coolant into said container past the waveguide.

7. The apparatus of claim 4, wherein said container further includes:

an elbow shaped inlet to allow said coolant to enter said container; and an elbow shaped outlet to allow said coolant to exit said container.

8. The apparatus of claim 2, wherein said void further includes a tube passing therethrough for containing a fluid coolant.

9. The apparatus of claim 8, wherein said tube comprises quartz.

10. An improved downstream remote processor utilizing a quartz waveguide, wherein the improvement comprises:

at least one heat conductive baffle fixed to the quartz waveguide, said baffle having at least one void therethrough; and a cooling fluid passing through said void such that said baffle and said cooling fluid dissipate heat generated within the waveguide.

11. The improved processor of claim 10, wherein said baffle comprises quartz fused to the waveguide.

12. The improved processor of claim 10, wherein said baffle interconnects the waveguide to an internal surface of the processor.

13. The improved processor of claim 10, wherein said void has a diameter of approximately $\frac{1}{8}$ inch.

14. The improved processor of claim 10, wherein said baffle has a length equal to an inside height of the processor and a width equal to an inside width of the processor.

15. The improved processor of claim 10, wherein said cooling fluid comprises nitrogen.

16. The improved processor of claim 10, further including a tube passing through said void for containing said cooling fluid.

17. The improved processor of claim 16, wherein said tube comprises quartz.

18. A method for cooling a quartz waveguide in a downstream remote processor, comprising the steps of:

surrounding the waveguide with a container; and connecting at least one heat conductor between said container and the waveguide such that said conductor removes heat generated within the waveguide to said container.

19. The method of claim 18, wherein the step of connecting comprises fusing a quartz baffle to the waveguide so that said baffle contacts said container.

20. The method of claim 19, further comprising the step of forming at least one void in said baffle.

21. The method of claim 20, further comprising the step of pumping a fluid coolant into said container past the waveguide and through said void.

22. The method of claim 20, further comprising the step of passing a quartz tube through said void to contain said fluid coolant.

23. A method for improving a downstream remote processor utilizing a quartz waveguide, comprising the steps of:

fixing at least one heat conductive baffle to the quartz waveguide;

forming at least one void through said baffle; and passing a cooling fluid through said void such that said baffle and said cooling fluid dissipate heat generated within the waveguide.

24. The method of claim 23, wherein the step of fixing comprises fusing a quartz baffle to the quartz waveguide.

25. The method of claim 23, wherein the step of fixing further comprises interconnecting the waveguide to an internal surface of the processor with said baffle.

26. The method of claim 23, further comprising the step of passing a quartz tube through said void for containing said cooling fluid.

27. Apparatus for cooling a waveguide in a downstream remote processor, comprising:

a container surrounding the waveguide;

at least one heat conductor interconnecting the waveguide and said container such that heat generated within the waveguide is removed by said conductor to said container;

a baffle fixed to the waveguide and in contact with said container, said baffle having at least one void passing therethrough; and a fluid coolant circulated through said container by passing through said void.

28. The apparatus of claim 27, wherein said baffle comprises quartz fused to the waveguide.

29. The apparatus of claim 27, wherein said fluid comprises nitrogen.

30. The apparatus of claim 27, further including a pump for forcing said coolant into said container past the waveguide.

31. The apparatus of claim 23, wherein said container further includes:

an elbow shaped inlet to allow said coolant to enter said container; and an elbow shaped outlet to allow said coolant to exit said container.

32. The apparatus of claim 23, wherein said void further includes a tube passing therethrough for containing a fluid collant.

33. The apparatus of claim 32, wherein said tube comprises quartz.

34. A method for cooling a quartz waveguide in a downstream remote processor, comprising the steps of:

surrounding the waveguide with a container; and connecting at least one heat conductor between said container and the waveguide such that said conductor removes heat generated within the waveguide to said container further comprising:

fusing a quartz baffle to the waveguide so that said baffle contacts said container forming at least one void in said baffle; and pumping a fluid coolant into said container past the waveguide and through said void.

* * * * *